US011974674B2

(12) United States Patent
Waller et al.

(10) Patent No.: US 11,974,674 B2
(45) Date of Patent: May 7, 2024

(54) SEAT WITH SLIDING BASE

(71) Applicant: Gary Platt Manufacturing, LLC, Reno, NV (US)

(72) Inventors: Daniel J. Waller, Reno, NV (US); Dylan Nettenstrom, Reno, NV (US)

(73) Assignee: Gary Platt Manufacturing, LLC, Reno, NV (US)

( * ) Notice: Subject to any disclaimer, the term of this patent is extended or adjusted under 35 U.S.C. 154(b) by 0 days.

(21) Appl. No.: 17/535,421

(22) Filed: Nov. 24, 2021

(65) Prior Publication Data

US 2022/0160129 A1 May 26, 2022

Related U.S. Application Data

(60) Provisional application No. 63/118,628, filed on Nov. 25, 2020.

(51) Int. Cl.

| | |
|---|---|
| ***A47C 7/00*** | (2006.01) |
| ***A47C 7/72*** | (2006.01) |
| ***A47C 15/00*** | (2006.01) |

(52) U.S. Cl.

CPC ..... *A47C 7/004* (2013.01); *A47C 7/727* (2018.08); *A47C 15/004* (2013.01)

(58) Field of Classification Search

CPC ..... A47C 15/004

USPC ..... 297/217.3, 217.4, 344.11; 248/500, 501

See application file for complete search history.

(56) References Cited

U.S. PATENT DOCUMENTS

| | | | | |
|---|---|---|---|---|
| 3,933,331 A | | 1/1976 | Blom | |
| 4,289,351 A | | 9/1981 | Wahls | |
| 4,530,540 A | | 7/1985 | Hayden et al. | |
| 4,840,343 A | * | 6/1989 | Gasser | A47C 7/002 248/500 |
| 5,083,738 A | * | 1/1992 | Infanti | A47C 9/00 248/500 |
| 5,102,192 A | * | 4/1992 | Barile, Sr. | A47C 9/00 248/501 |
| 5,280,987 A | | 1/1994 | Miller | |

(Continued)

FOREIGN PATENT DOCUMENTS

| | | | | |
|---|---|---|---|---|
| DE | 202012008661 U1 | * | 9/2012 | A47C 15/004 |
| DE | 202012008647 U1 | * | 10/2012 | A47C 15/004 |

(Continued)

OTHER PUBLICATIONS

United States Patent and Trademark Office, "Notice of Allowance," issued in connection with U.S. Appl. No. 16/149,965, dated Feb. 21, 2020, 44 pages.

(Continued)

*Primary Examiner* — Rodney B White

(74) *Attorney, Agent, or Firm* — Hanley, Flight & Zimmerman, LLC

(57) ABSTRACT

A movable seat such as for use with a gaming device is disclosed and described herein. An example chair includes a chair portion and a base portion. The base portion includes a support member, a slide portion, and a floorplate. The example chair portion is affixed to the support member, and the support member is movably affixed to a mounting plate in the slide portion to enable the chair portion to slide along at least a portion of a length of the floorplate.

12 Claims, 18 Drawing Sheets

(56) References Cited

U.S. PATENT DOCUMENTS

| | | | | |
|---|---|---|---|---|
| 5,409,296 | A * | 4/1995 | Barile | A47C 9/022 248/172 |
| 5,522,641 | A * | 6/1996 | Infanti | G07F 17/3216 297/344.13 |
| 5,542,748 | A * | 8/1996 | Barile | A47C 15/004 248/500 |
| 5,678,886 | A * | 10/1997 | Infanti | A47C 9/00 248/500 |
| 5,762,617 | A * | 6/1998 | Infanti | G07F 17/3216 297/344.13 |
| 5,791,731 | A * | 8/1998 | Infanti | A47C 15/004 297/217.3 |
| 6,354,660 | B1 * | 3/2002 | Friedrich | A63F 13/08 248/500 |
| 6,422,526 | B1 | 7/2002 | Ishikawa et al. | |
| 7,407,228 | B1 * | 8/2008 | Infanti | A47C 15/004 248/500 |
| 7,658,445 | B2 * | 2/2010 | Mittler | A47C 15/004 297/217.3 |
| 7,832,799 | B2 | 11/2010 | Davis, Jr. et al. | |
| 7,922,134 | B2 | 4/2011 | Gasser | |
| 8,000,484 | B2 * | 8/2011 | Rasmussen | A47C 7/72 381/301 |
| D654,728 | S | 2/2012 | Gasser | |
| 9,532,655 | B2 * | 1/2017 | Iulita | A47C 9/022 |
| 2007/0228784 | A1 | 10/2007 | Wells, Jr. | |
| 2007/0296255 | A1 | 12/2007 | Cadwallader | |
| 2008/0136228 | A1 * | 6/2008 | Friedrich | A47C 7/002 297/217.3 |
| 2009/0152922 | A1 | 6/2009 | Gasser | |
| 2009/0179479 | A1 * | 7/2009 | Davis, Jr. | A47C 15/004 297/463.1 |
| 2012/0104218 | A1 | 5/2012 | Nonomiya | |
| 2015/0034791 | A1 | 2/2015 | Yamada et al. | |
| 2015/0150376 | A1 | 6/2015 | Hogue | |
| 2015/0251047 | A1 | 9/2015 | Maaniitty et al. | |
| 2017/0341532 | A1 | 11/2017 | Sowinski et al. | |
| 2018/0022237 | A1 | 1/2018 | Nomura et al. | |
| 2019/0099000 | A1 | 4/2019 | Waller et al. | |
| 2019/0126785 | A1 | 5/2019 | Sasaki et al. | |
| 2020/0032334 | A1 | 10/2020 | Waller et al. | |
| 2021/0106140 | A1 * | 4/2021 | Corrick | H02J 50/12 |
| 2021/0206303 | A1 | 7/2021 | Petit et al. | |

FOREIGN PATENT DOCUMENTS

| | | | | |
|---|---|---|---|---|
| DE | 202012008661 | U1 * | 11/2012 | A47C 1/023 |
| DE | 202012008647 | U1 * | 12/2012 | A47C 15/004 |
| DE | 102017104498 | | 9/2018 | |
| WO | 2018158174 | | 9/2018 | |
| WO | 2020042748 | | 3/2020 | |

OTHER PUBLICATIONS

United States Patent and Trademark Office, "Requirement for Restriction," issued in connection with U.S. Appl. No. 16/149,965, dated Oct. 30, 2019, 7 pages.

United States Patent and Trademark Office, "Notice of Allowance," issued in connection with U.S. Appl. No. 16/913,072, dated Sep. 30, 2021, 14 pages.

* cited by examiner

SEAT WITH SLIDING BASE

CROSS-REFERENCE TO RELATED APPLICATION

This patent claims priority to and the benefit of U.S. Provisional Patent Application No. 63/118,628, entitled "Seat with Sliding Base," filed Nov. 25, 2020, which is incorporated herein by reference in its entirety for all purposes.

FIELD OF THE DISCLOSURE

This disclosure relates generally to seats, and, more particularly, to seats with sliding base floorplate assemblies.

BACKGROUND

Casino operators often desire chairs for gaming machines, such as, for example, slot machines, to be attached to the machine or to a location adjacent to the machine. This promotes a more orderly and safer casino by preventing inappropriate use or movement of casino chairs. Many jurisdictions require casino operators to use fixed or attached chairs. At the same time, casino chairs are often expected to be movable and/or otherwise adjustable with respect to a gaming machine to accommodate a variety of players and/or a variety of gaming machine configurations. However, stability, protection of cables and underlying electronics, and ease of movement/configurability can be a significant problem with movable chair design.

BRIEF DESCRIPTION OF THE DRAWINGS

The figures are not to scale. Wherever possible, the same reference numbers will be used throughout the drawing(s) and accompanying written description to refer to the same or like parts.

DETAILED DESCRIPTION

Figure 1:
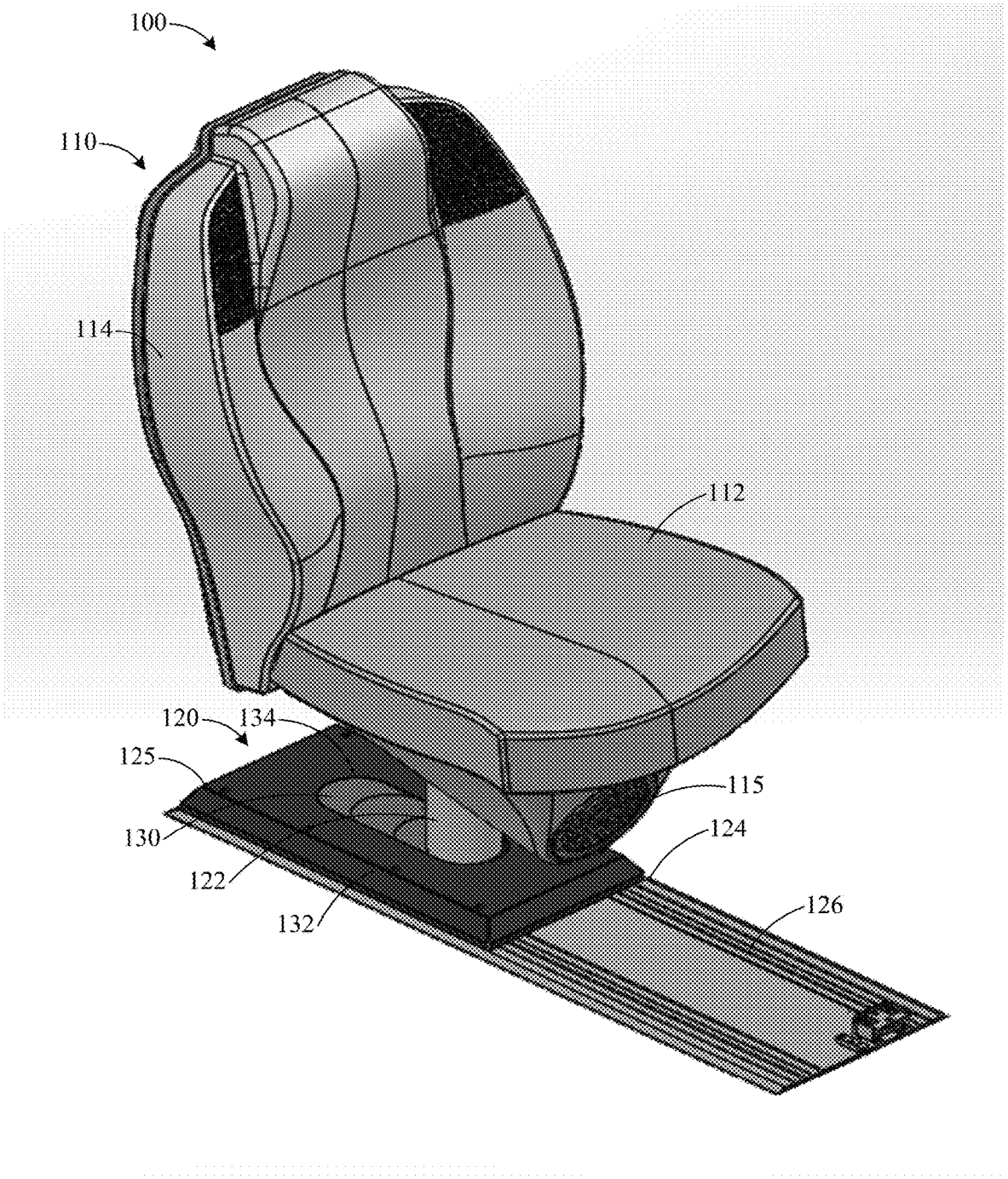
FIGS. 1-18 illustrate a plurality of views of an example chair and associated floorplate assembly.

In the following detailed description, reference is made to the accompanying drawings that form a part hereof, and in which is shown by way of illustration specific examples that may be practiced. These examples are described in sufficient detail to enable one skilled in the art to practice the subject matter, and it is to be understood that other examples may be utilized and that logical, mechanical, electrical and other changes may be made without departing from the scope of the subject matter of this disclosure. The following detailed description is, therefore, provided to describe an example implementation and not to be taken as limiting on the scope of the subject matter described in this disclosure. Certain features from different aspects of the following description may be combined to form yet new aspects of the subject matter discussed below.

When introducing elements of various embodiments of the present disclosure, the articles "a," "an," "the," and "said" are intended to mean that there are one or more of the elements. The terms "first," "second," and the like, do not denote any order, quantity, or importance, but rather are used to distinguish one element from another. The terms "comprising," "including," and "having" are intended to be inclusive and mean that there may be additional elements other than the listed elements. As the terms "connected to,"

"coupled to," etc. are used herein, one object (e.g., a material, element, structure, member, etc.) can be connected to or coupled to another object regardless of whether the one object is directly connected or coupled to the other object or whether there are one or more intervening objects between the one object and the other object.

As used herein, singular references (e.g., "a", "an", "first", "second", etc.) do not exclude a plurality. The term "a" or "an" entity, as used herein, refers to one or more of that entity. The terms "a" (or "an"), "one or more", and "at least one" can be used interchangeably herein. Furthermore, although individually listed, a plurality of means, elements or method actions may be implemented by, e.g., a single unit or processor. Additionally, although individual features may be included in different examples or claims, these may possibly be combined, and the inclusion in different examples or claims does not imply that a combination of features is not feasible and/or advantageous.

The term "and/or" when used, for example, in a form such as A, B, and/or C refers to any combination or subset of A, B, C such as (1) A alone, (2) B alone, (3) C alone, (4) A with B, (5) A with C, (6) B with C, and (7) A with B and with C. As used herein in the context of describing structures, components, items, objects, and/or things, the phrase "at least one of A and B" is intended to refer to implementations including any of (1) at least one A, (2) at least one B, and (3) at least one A and at least one B. Similarly, as used herein in the context of describing structures, components, items, objects and/or things, the phrase "at least one of A or B" is intended to refer to implementations including any of (1) at least one A, (2) at least one B, and (3) at least one A and at least one B. As used herein in the context of describing the performance or execution of processes, instructions, actions, activities and/or steps, the phrase "at least one of A and B" is intended to refer to implementations including any of (1) at least one A, (2) at least one B, and (3) at least one A and at least one B. Similarly, as used herein in the context of describing the performance or execution of processes, instructions, actions, activities, and/or steps, the phrase "at least one of A or B" is intended to refer to implementations including any of (1) at least one A, (2) at least one B, and (3) at least one A and at least one B.

In addition, it should be understood that references to "one embodiment" or "an embodiment" of the present disclosure are not intended to be interpreted as excluding the existence of additional embodiments that also incorporate the recited features.

Certain examples provide a casino or gaming chair, stool, and/or other seat (hereinafter referred to as a "chair") that can be movably positioned with respect to another device such as a gaming machine (e.g., a slot machine, video poker machine, other electronic gaming machine (EGM), etc.), gaming table (e.g., poker table, roulette table, craps table, etc.), bar, counter, etc. The chair allows a user to position themselves with respect to the other device to interact with the other device. In certain examples, the chair can be slidable and/or otherwise positionable with respect to the slot machine, EGM, or other device. For example, the chair can be slidable and/or otherwise positionable along its base to adjust to be closer to or farther from the other device. In certain examples, the base can hook into, be inserted into, snap against, and/or otherwise be positioned in and/or abut the other device. In certain examples, wires and/or other connections can extend from the other device to the chair and be covered and/or otherwise camouflaged by the base of the chair.

The chair includes a chair seat portion, a chair back portion attached to an end of the chair seat portion, and a pedestal, column, or other support member attached at a first end to an underside of the chair seat portion. The pedestal/column can be attached at a second end to a base, slide plate, or column mount. The base/slide plate can be slidable with respect to a footboard or floorplate, which rests on the floor, ground, etc.

In certain examples, the chair is foam-filled (e.g., cold-cured foam blend, other high density molded foam, etc.) for user comfort (e.g., the seat base and/or seat back of the chair can be filled with foam, etc.). In certain examples, the foam is injection molded with built-in lumbar support and other contours to fit the human form. In certain examples, the seat or chair base has a waterfall front edge to relieve stress on a user's legs. In certain examples, the wood is contoured to match the foam to help ensure that neither the wood nor the foam will break down over time. In certain examples, the chair frame incorporates a slider glides that makes the chair easy to move and more user-friendly. In certain examples, a frame of the chair is built with an all-welded construction and designed to stand up to the heavy demands of 24/7 casino use. In certain examples, a base of the chair is an aluminum and/or other metal base.

In certain examples, the chair is coated with a film and/or covered in a liner to provide antimicrobial, antibacterial, and/or other sanitary coating. In certain examples, upholstery of the chair inhibits microbiological growth and is also anti-fungal and anti-mildew to prevent harmful growth or spread of virus, bacteria, etc. Such upholstery can be bleach-cleanable, for example.

In certain examples, the chair can include one or more lights (e.g., light-emitting diode (LED) lights, incandescent lights, low-voltage lights, etc., powered to provide ambience for someone sitting in the chair and/or effects to accompany and/or otherwise enhance a user's game and/or other entertainment experience. The one or more lights can be attuned to game play to change color, motion pattern, etc., based on a state of an associated game or gaming machine, based on ongoing game play, based on a preset mode, based on an event or promotion, etc. The one or more lights can also include ultraviolet light for sterilization, etc. The chair can also include one or more speakers (e.g., low-voltage speakers, etc.), phone/tablet computer charging pad, and/or other electronics, etc., that require power for operation. Power for lights, speakers, recharging, other chair functions (e.g., motion, vibration, etc.), etc., can be provided through a wired power connection in the base of the chair, for example. A wire running through the base and into the chair can connect to a power source in a gaming machine, table, wall, bar, etc.

FIG. 1 illustrates an example perspective view of an example chair 100 including a chair portion 110 and a base portion 120. The base portion 120 includes a pedestal or other support member 122 and a floorplate assembly 124. The chair portion 110 includes a chair seat 112 and a chair back 114. The chair back 114 can include speakers, lights, power and/or data connection, etc. The chair seat portion 112 is connected to the pedestal 122, which is attached to the floorplate assembly 124 of the base. As shown in the example of FIG. 1, a speaker 115 can be connected underneath the seat portion 112, etc. Alternatively or in addition, a light, power and/or data connection, etc., can be positioned underneath the chair seat portion 112, for example. The floorplate assembly 124 includes a base or slide plate 125 and a floorplate 126. The floorplate 126 is in contact with the floor or ground, and the base/slide portion 125 moves with respect to the floorplate, allowing the chair 100, which is attached to the base 125 via the support member 122, to move along at least a portion of a length of the floorplate 126 as well. In certain examples, the chair portion 110 can also swivel left and/or right with respect to the floorplate 126, while remaining in a plane parallel to a plane of the floorplate 126, with a default position aligned with a length of the floorplate 126.

As shown in the example of FIG. 1, the support member/pedestal 122 is attached to an underside of the chair seat 112 and is associated to a plate 130 that is inside a cover 132 of the slide portion of the base 125. The cover 132 has an opening 134 to allow the support member 122 and its mounting plate 130 to move within the opening 134 along at least a portion of the length of the floorplate 126, for example. In certain examples, the opening 134 in the cover 132 of the slide portion 125 allows for the support member 122 to be adjustably positioned such that the chair 100 can be closer to or farther from an end of the floorplate 126 (and the base slide portion 125). Thus, for example, if the floorplate 126 is attached to a gaming machine, the chair 100 can be positioned closer to or farther from the gaming machine. Once positioned in the sliding base 125, the sliding base 125 may still be able to slide back and forth along at least a portion of the floorplate 126, for example.

Thus, a user can sit on the chair seat portion 112 and move the seat 112 and back 114 portions of the chair 100 via the support member 122 and slide portion 125 with respect to the floorplate 126 (e.g., along a track, slot, groove, etc.). While the support member 122 is shown in the example of FIG. 1 as a cylindrical support member or pedestal/column, the support member 122 can be rectangular, elliptical, and/or other shape to connect the chair seat portion 112 to the slide portion 125.

Thus, a sliding chair base, such as the floorplate assembly 124, can connect the chair 100 to a slot machine, electronic gaming machine, and/or other gaming device, for example. In other examples, the floorplate assembly 124 is not connected to the other device but is positioned in front of and/or otherwise adjacent to (e.g., abutting, etc.) the other device so that a user can sit in the chair 100 and interact with the gaming machine and/or other device.

In certain examples, the chair can include a speaker, subwoofer, and/or other motion generator. The speaker can generate sound effects to accompany a game being played via a gaming device positioned adjacent to the chair, for example. As a subwoofer or motion generator, the device can cause the chair seat portion and/or the seat back portion to move, shake, vibrate, etc., for example.

In certain examples, the floorplate can have groove, stopper, guide, etc., limiting the slide plate from traversing an entire length of the floorplate, for example. In certain examples, one or more of the chair seat portion, chair back portion, support member, and slide plate can be formed as a single piece and/or integrated structure attached to other components and positioned with respect to the floorplate. In certain examples, the chair back portion can tilt or recline with respect to the chair seat portion, for example. In certain examples, the chair seat portion can be raised or lowered along the support member to adjust a height of the chair set portion/chair back portion for a user.

Figure 2:
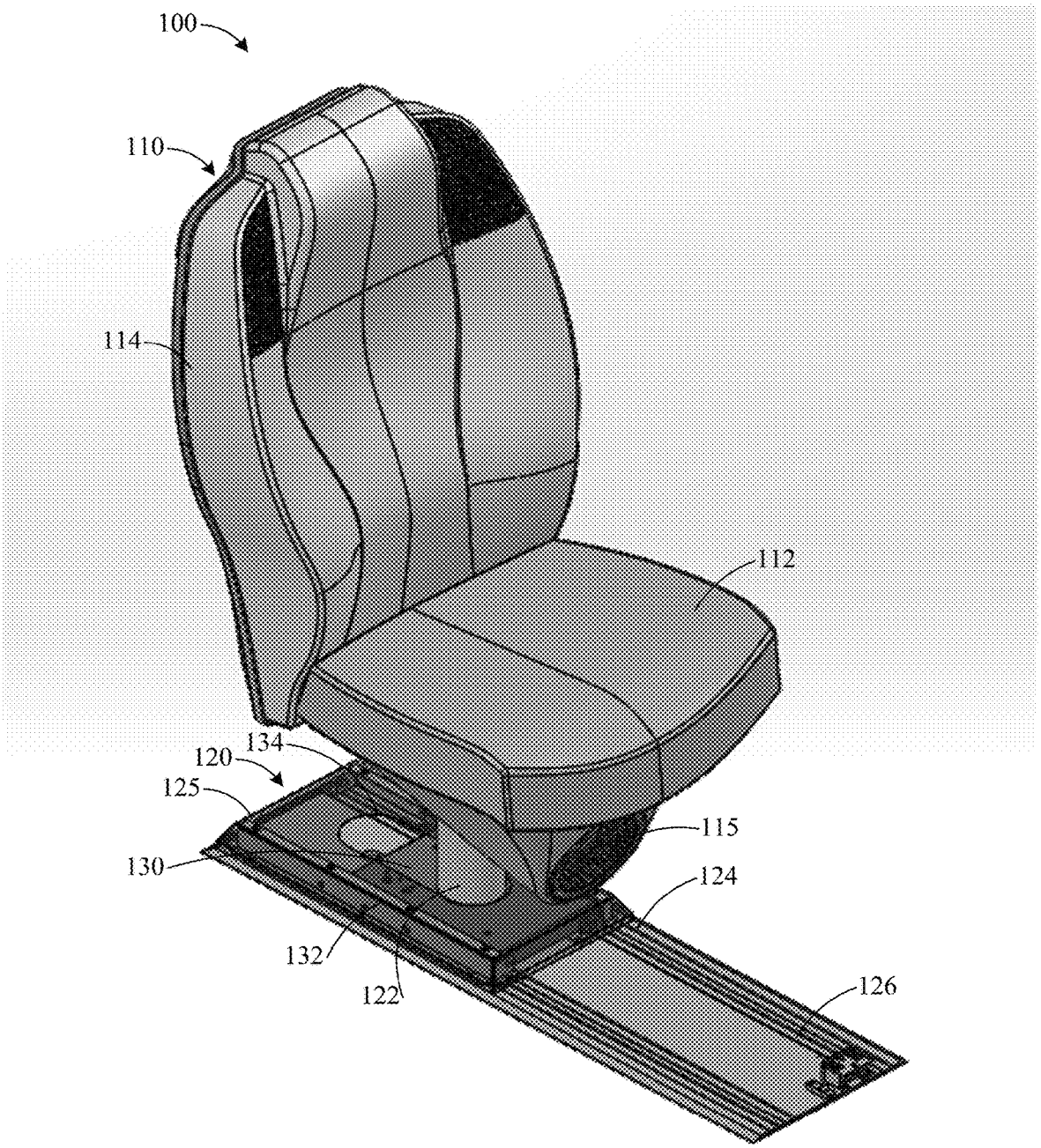
Figure 3:
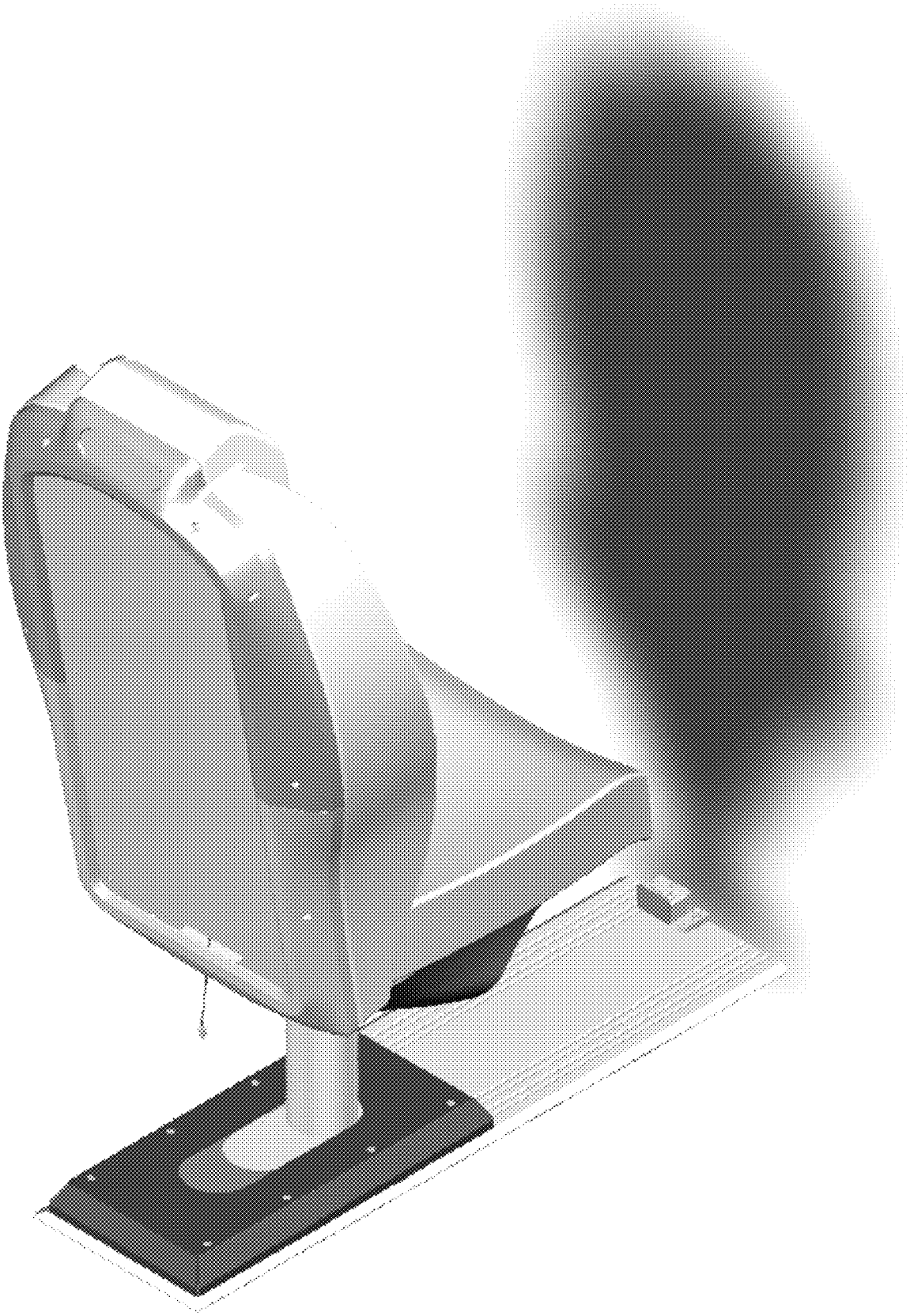
Figure 4:
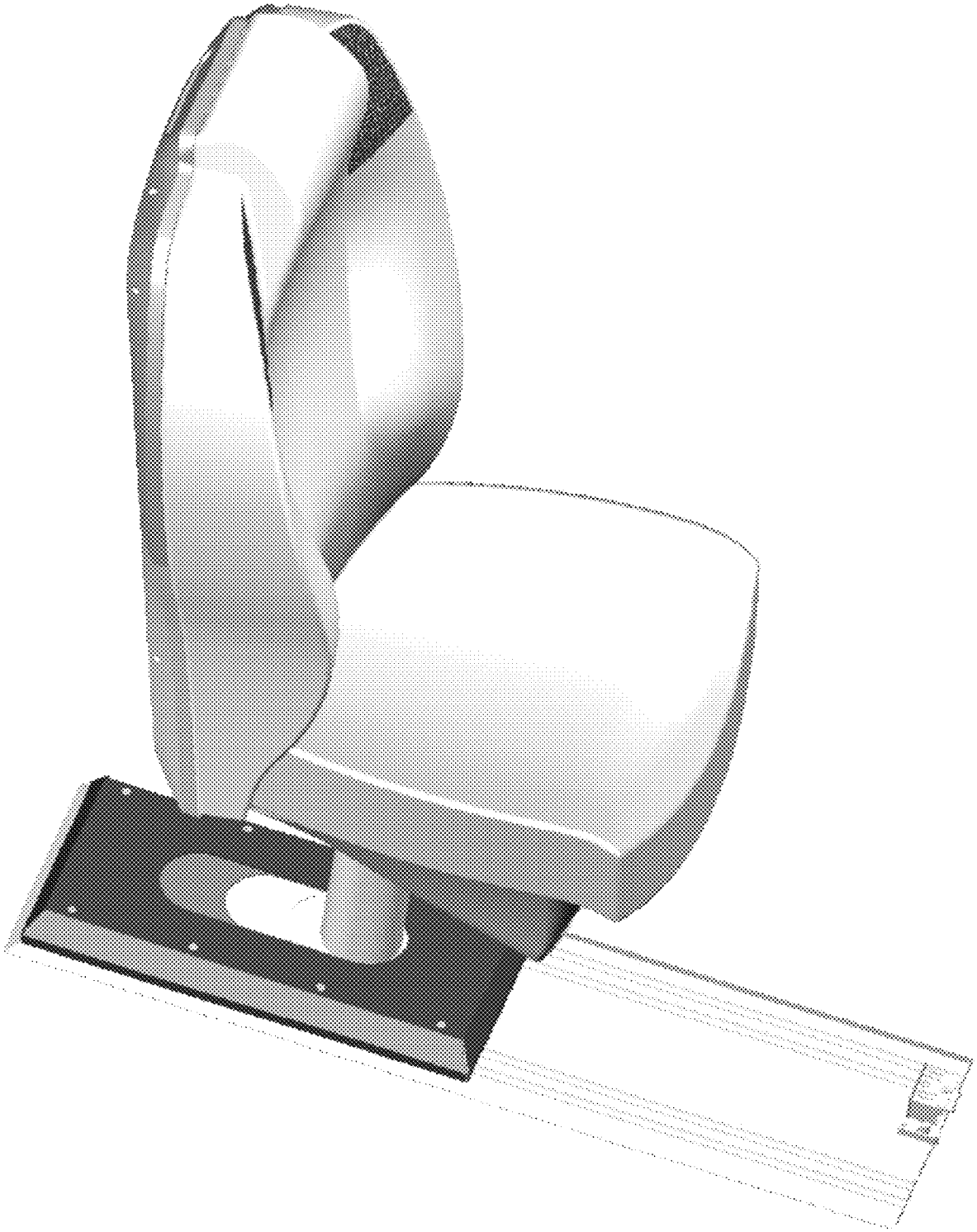
Figure 5:
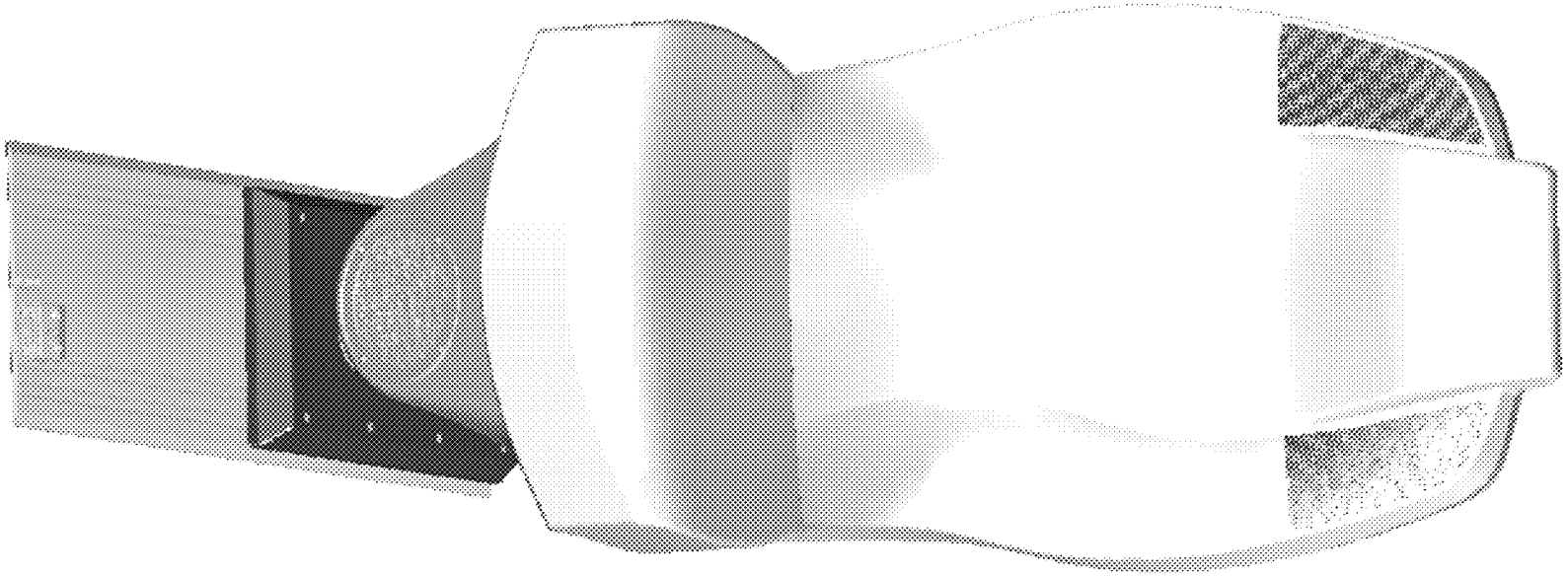
Figure 6:
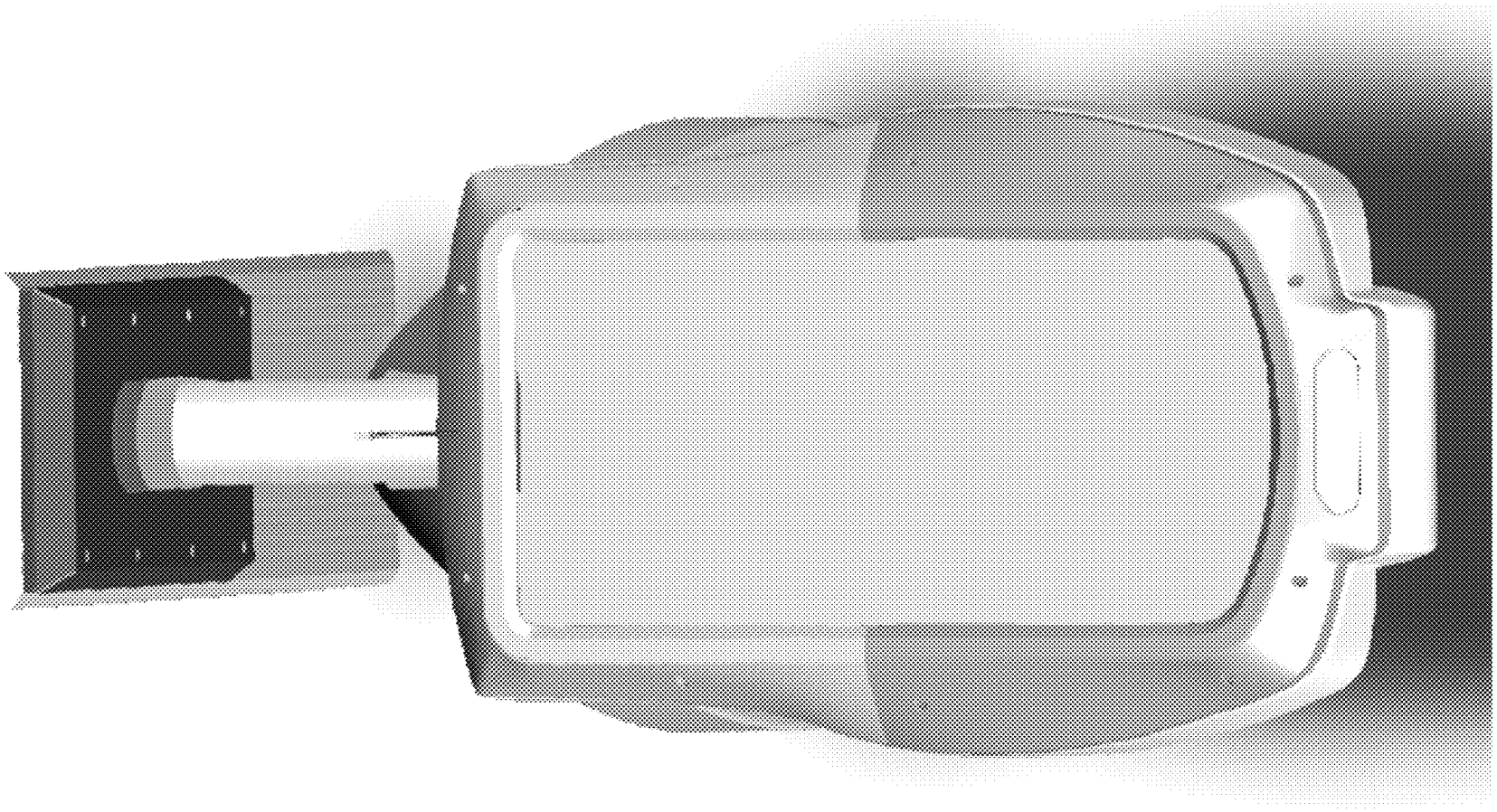

FIG. 2 illustrates another example perspective view of the chair 100 with a transparent view through the cover 132 of the sliding portion 125 of the base 120. FIG. 3 is a rear perspective view of the chair portion 110 and base portion 120 (showing a shadow projected by the chair in light). FIG. 4 is a top-down looking perspective view of the chair 100, and FIG. 5 is a front view facing the example chair 100. FIG. 6 shows an example back view of the chair 100.

As shown in the examples of FIGS. 1-6, the mounting plate 130 is positioned inside the cover 132 and the support member 122 is affixed to the mounting plate 130 through an opening 134 in the cover 132. The plate 130 can slide and/or otherwise be positioned within the opening 134 to adjust a position of the chair. A width of the cover 132 is less than a width of the floorplate 126, and a width of the mounting plate 130 is less than the width of the cover 132.

Figure 7:
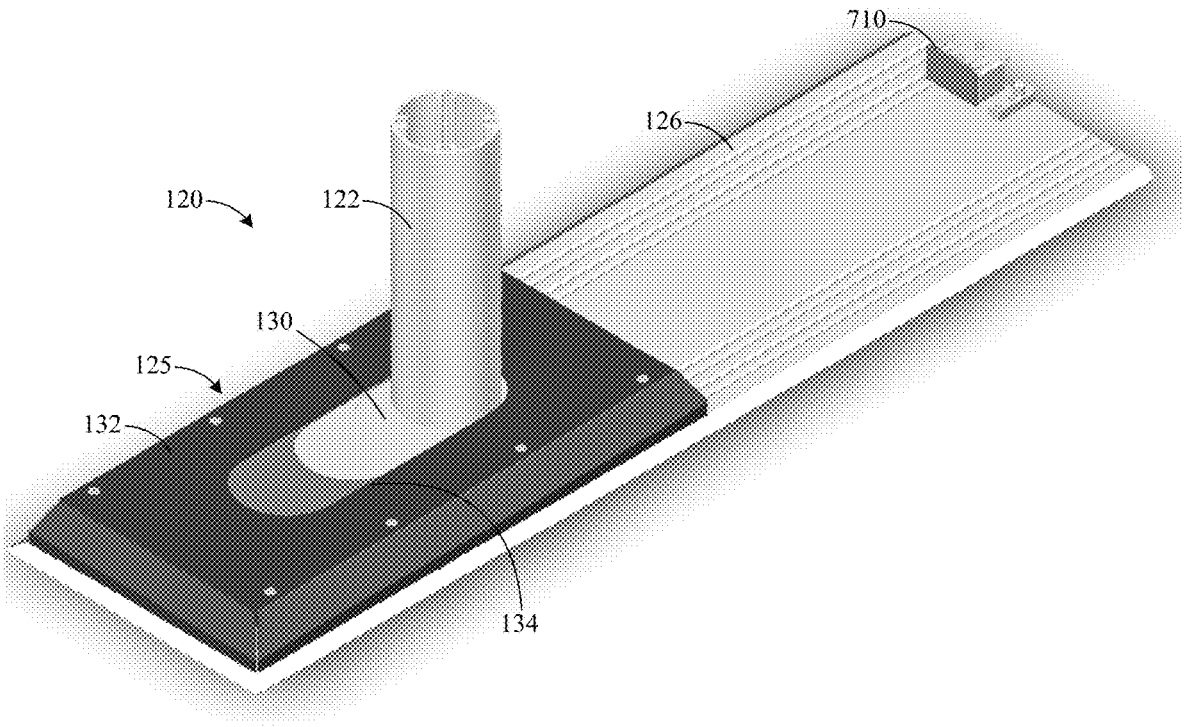

FIG. 7 shows the base portion 120 including support member 122, sliding portion 125, and floorplate 126 without the chair portion 110. As shown in the example of FIG. 7, a connector 710 can be provided to connect the floorplate 126 to another item, such as a gaming machine, a bar, a table, etc. The example connector 710 can include a conduit for wiring and/or wiring to connect electronics, such as the speaker 115, to an external power source such as an electronic gaming machine, a wall or floor outlet, etc., and/or other external device (e.g., a server, another computing device, an electronic gaming, machine, etc.). The conduit enables wires to be safely and securely positioned and routed from portions of the chair 100 (e.g., the speaker 115, any motored portion of the sliding base portion 125, lighting, charging port, etc.) to an external device/power source.

Figure 8:
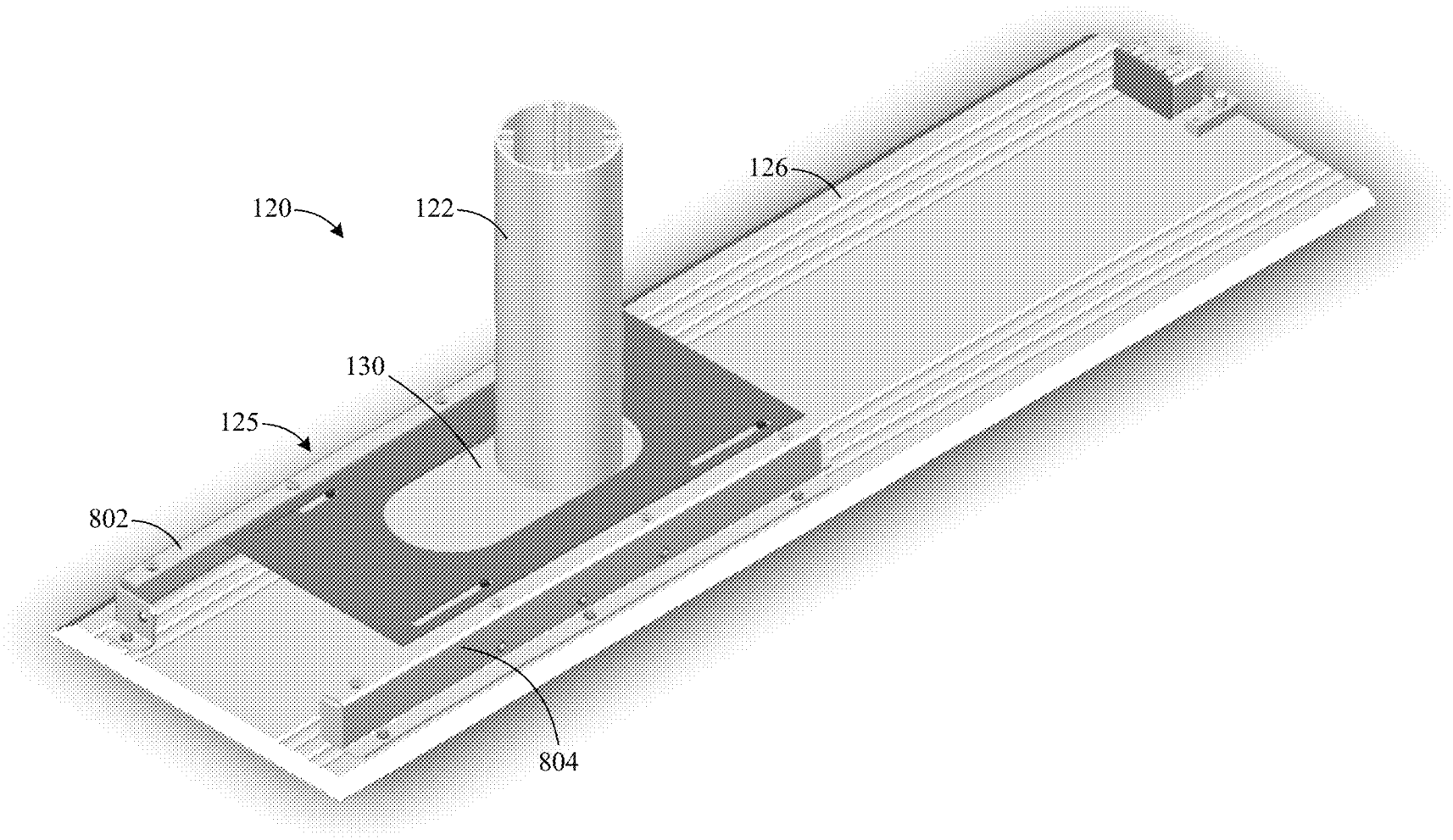

FIG. 8 illustrates the base portion 120 with the cover 132 removed, showing the mounting plate 130 for the support member 122 within the confines of the sliding base portion 125. Rails 802, 804 allow the mounting plate 130 and associated attachment mechanism (not shown in this view) to move within the sliding base portion 125 along a portion of the floorplate 126, for example. The rails 802, 804 are positioned within the cover 132 (not shown in this view) to allow contained movement of the mounting plate 130 and pedestal 122 within the confines of the sliding base portion 125.

Figure 9:
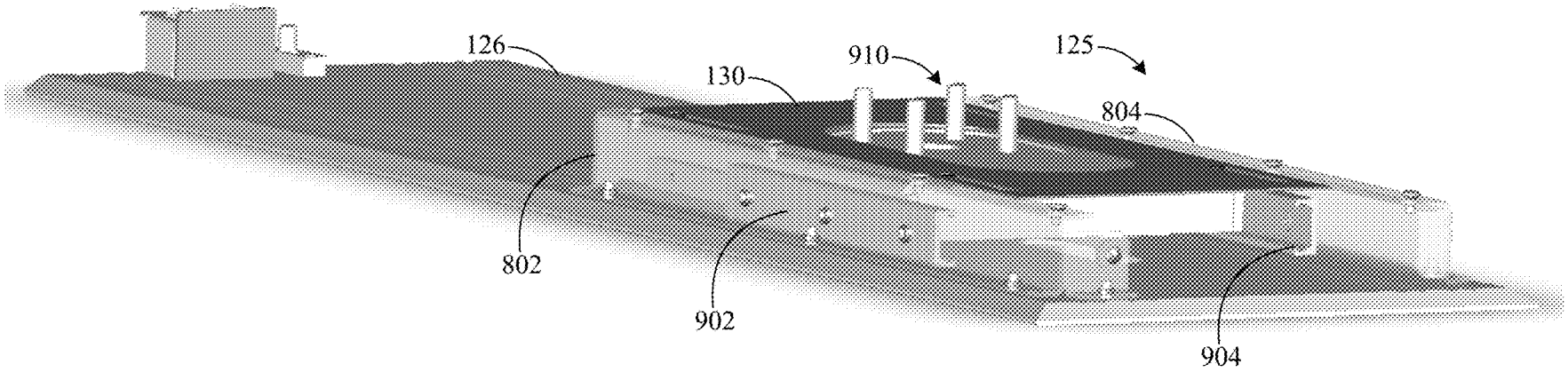

FIG. 9 shows another view of the sliding base portion 125 with the cover 132 removed. As shown in the view of FIG. 9, guides 902, 904 affixed to the mounting plate 130 enable the mounting plate 130 to move along the rails 802, 804 under the cover 132 (not shown in this view) within the sliding base portion 125. As shown in the view of FIG. 9, mounts 910 on the mounting plate 130 allow the support member 122 to be attached to the mounting plate 130. The guides 902, 904 allow the support member 122 to travel along a portion of the length of the floorplate 126 along the rails 802, 804 within the sliding base portion 125. The example guide systems 902, 904, which may be single pieces or multiple pieces (e.g., one piece affixed to the mounting plate 130 and another piece positioned within the respective rail 802, 804) form an attachment mechanism for the mounting plate 130.

In certain examples, a length of the plate in the direction along the floorplate 126 is 11 inches, and the seat depth is 19 inches. As such, a ratio of plate length to seat depth is 0.58, for example. In certain examples, the seat height is 21 inches. As such, a ratio of plate length to seat height of 0.52, for example, and a ratio of seat depth to seat height is 0.90, for example.

Figure 10:
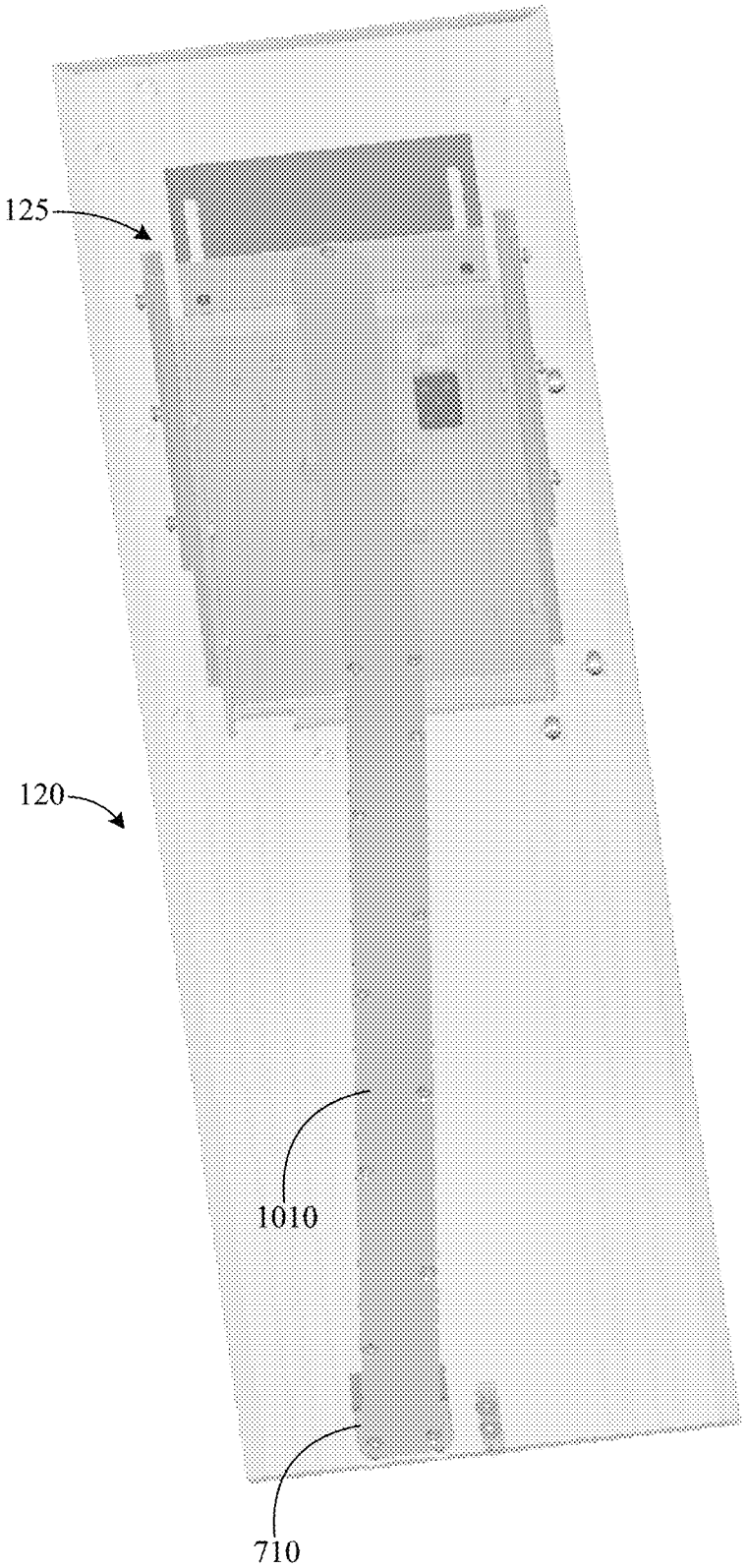

FIG. 10 illustrates a bottom view looking into the floorplate assembly, showing the sliding base portion 125 and a conduit 1010 through which power and/or data cables can be routed to connect to a gaming machine, computer, terminal, power supply, etc. The example conduit 1010 can be connected to the example connector 710 to provide power, data, etc., between devices in the chair 100, such as the speaker 115, etc., and an external source, such as a gaming machine, a power source, a server, a meter, a sensor, etc. The conduit 10010 enables wires to be safely and securely positioned and routed from portions of the chair 100 (e.g., the speaker 115, any motored portion of the sliding base portion 125, lighting, charging port, etc.) to an external device/power source without being exposed to risk of being cut, pinched, and/or otherwise damaged, rerouted, etc.

Figure 11:
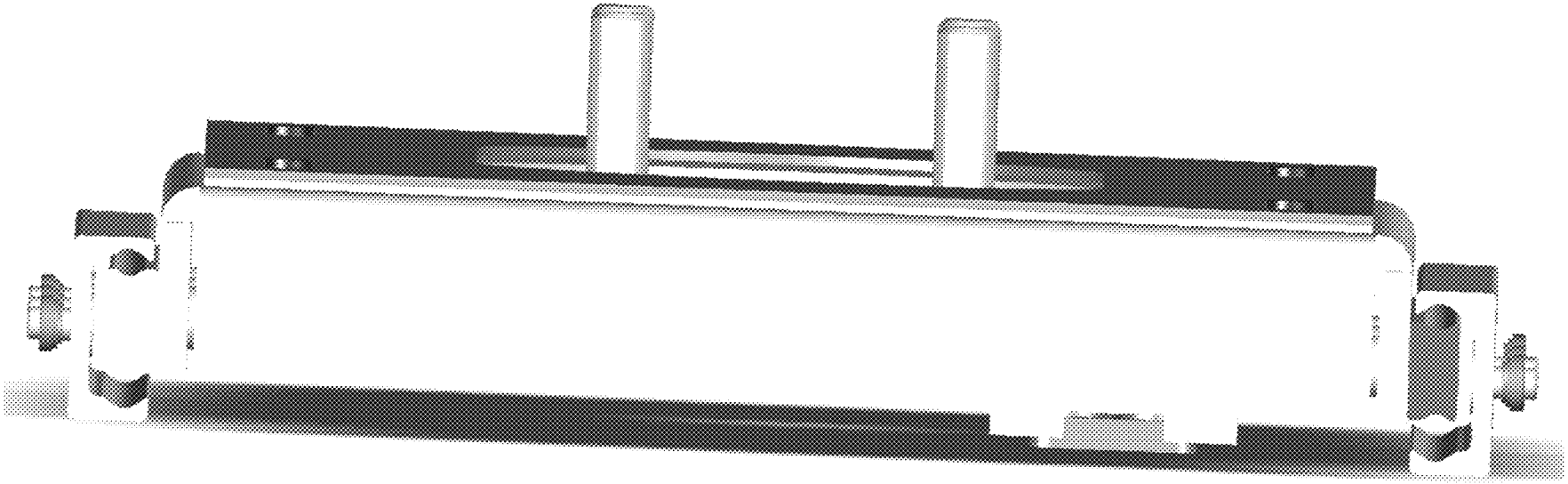
Figure 12:
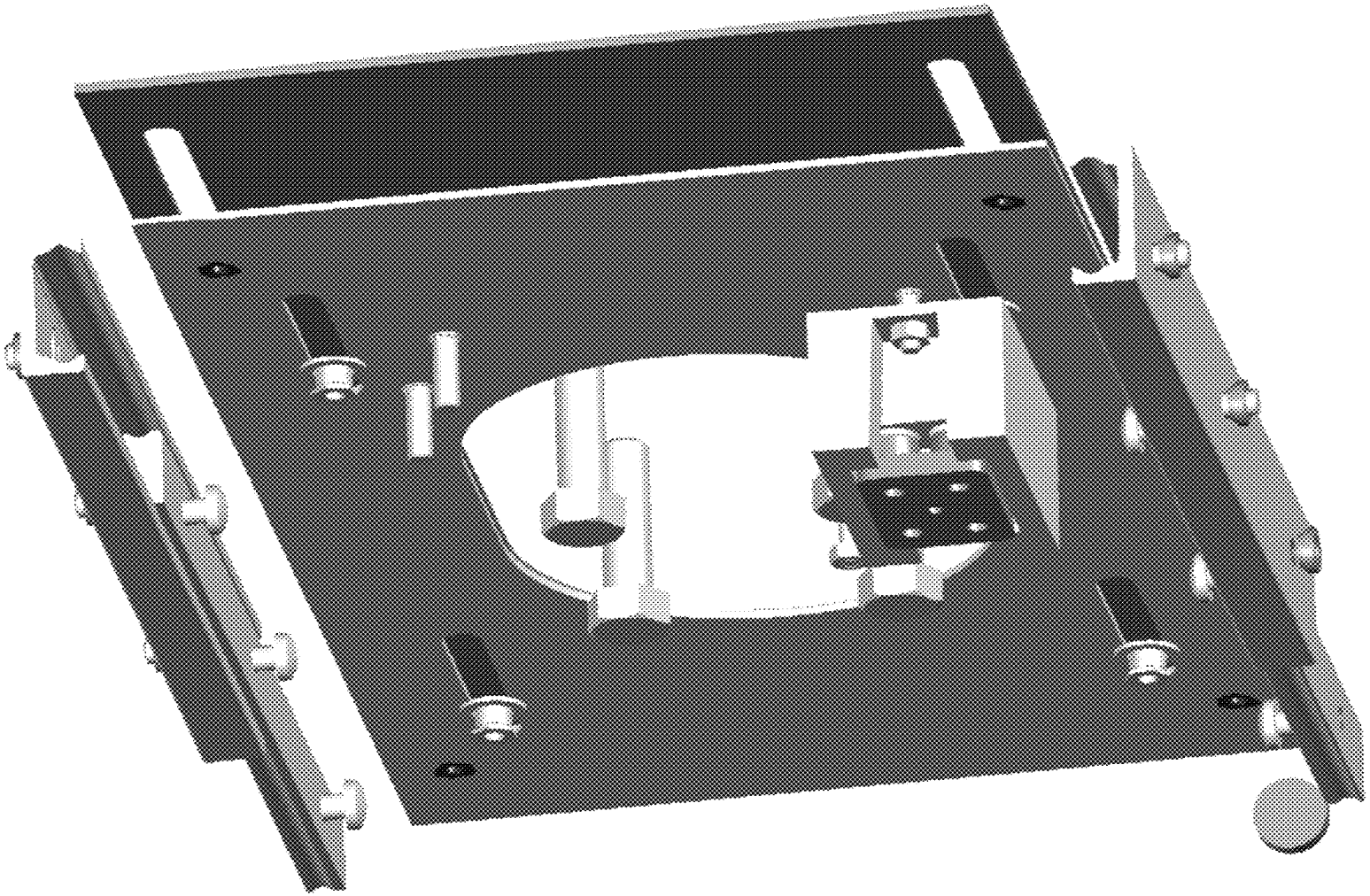
Figure 13:
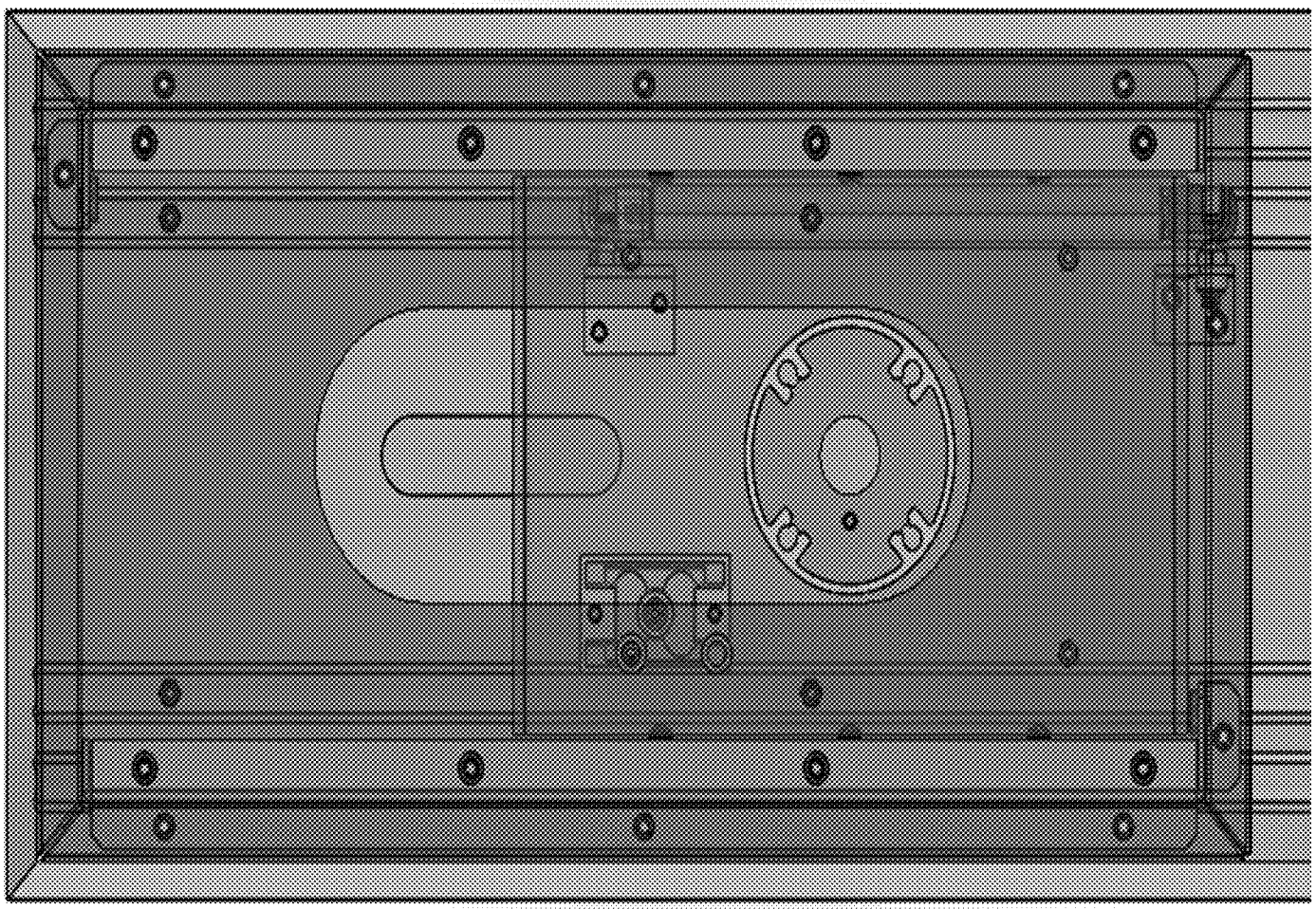
Figure 14:
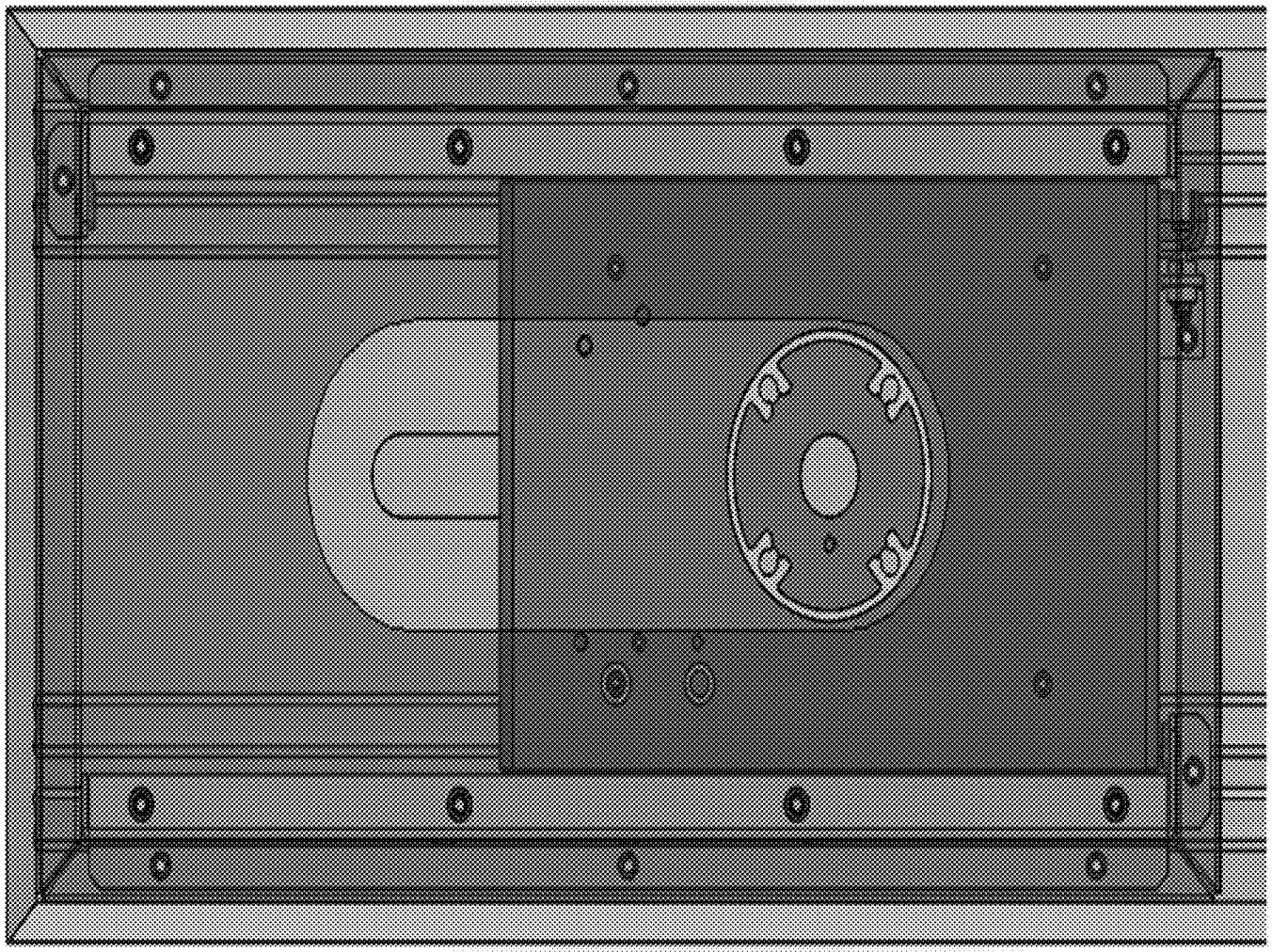
Figure 15:
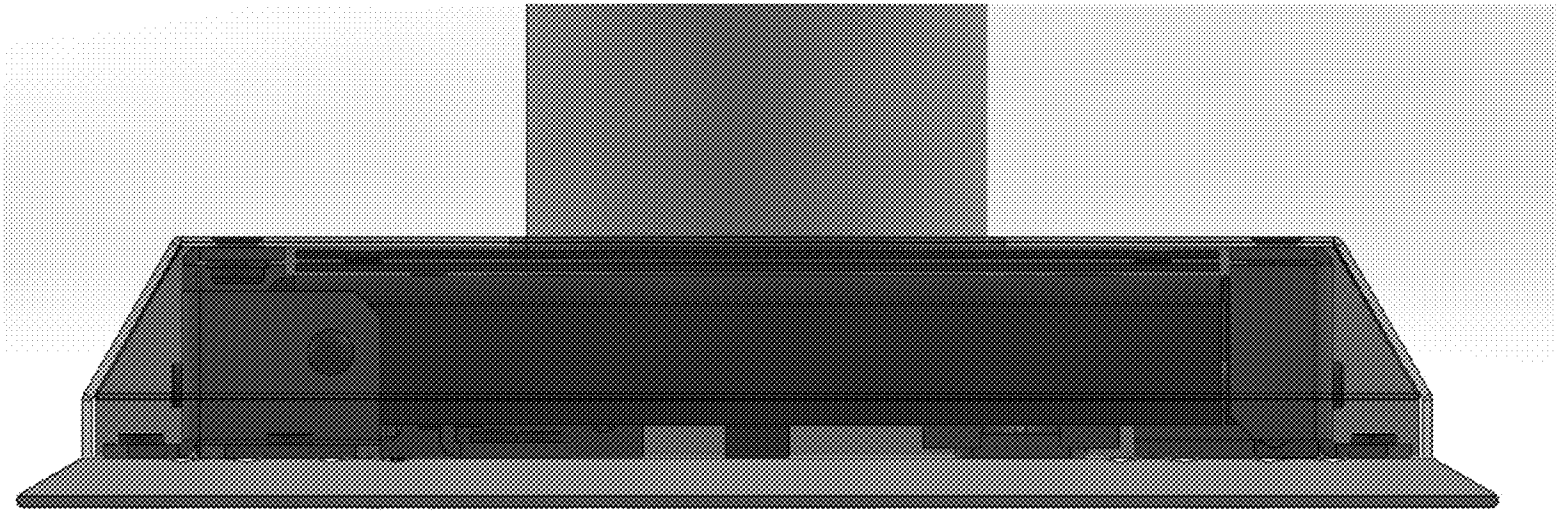
Figure 16:
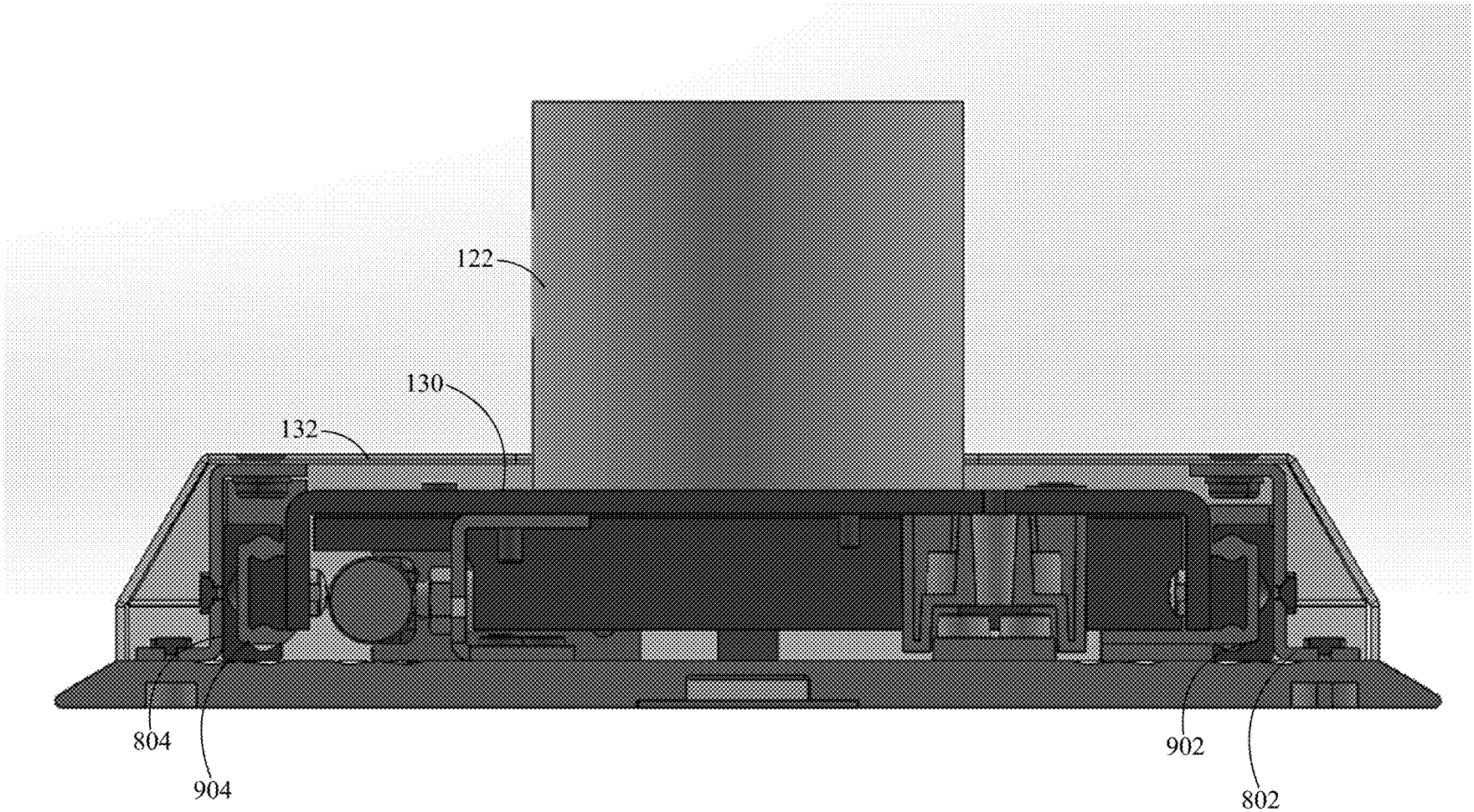
Figure 17:
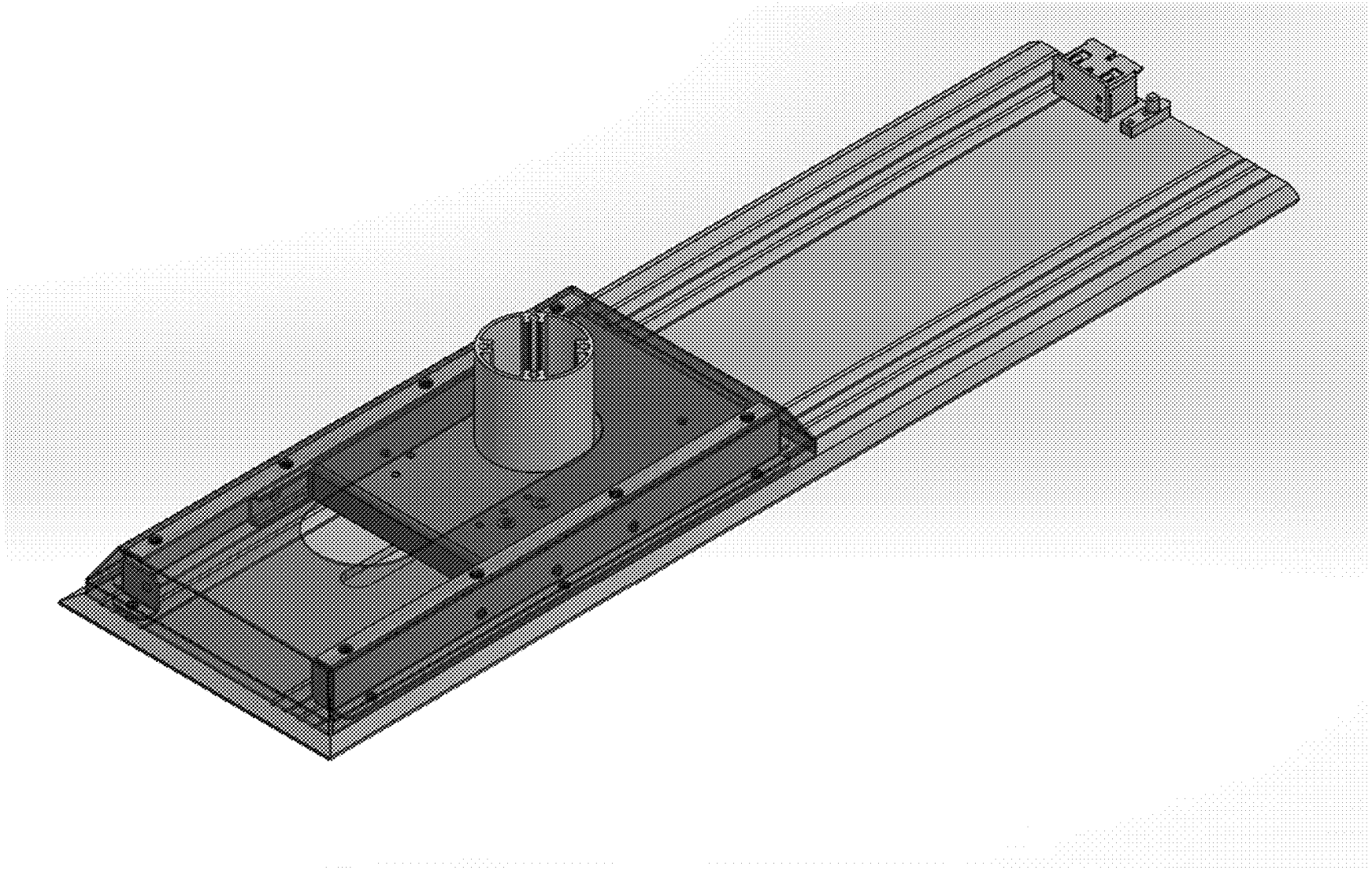
Figure 18:
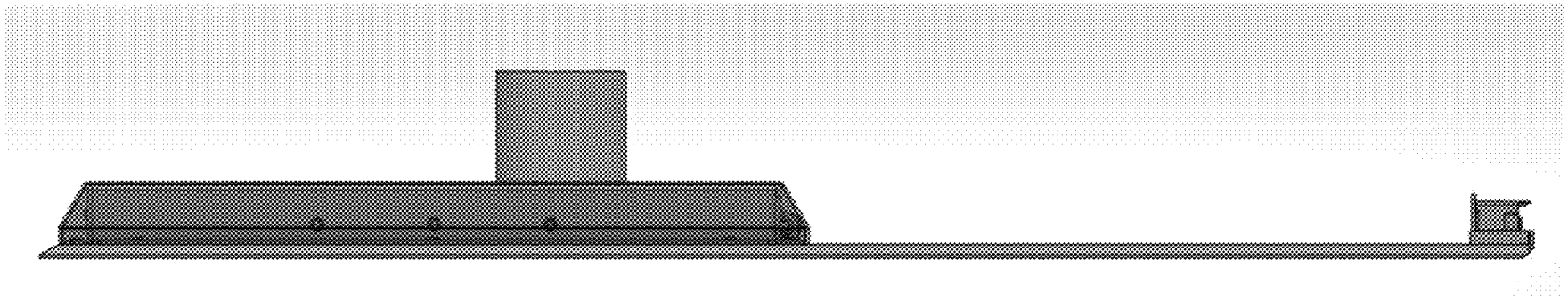

FIGS. 11-12 illustrate additional view of the components of the sliding base portion 125 with the cover 132 removed. FIGS. 13-14 illustrate example views of the base portion 120 with sliding base 125 and floorplate 126. FIGS. 15-16 illustrate cross-sections of the example sliding base portion 125 looking along a length of the floorplate 126. FIG. 17 depicts another example perspective view of the base portion 120 with the cover 132 on the sliding portion 125 made transparent. FIG. 18 depicts a side view of the example base portion 125 including the support member 122, the sliding base 125, and the floorplate 126.

Thus, certain examples provide a chair with a gaming machine interface that includes a single tongue sled connection with quick release and blind insert, for ease of connection to and removal from a gaming machine and/or other device. Certain examples provide a chair back portion including lighting and/or sound such as a back lit panel insert, etc., as well as lumbar support. In certain examples, an insert to the back lit panel mounts easily and allows interchangeable inserts to be positioned. Certain examples provide a seat portion that can move 2-4 inches forward and 2-4 inches back from a default or center position. Certain examples provide a seat portion that can swivel. In certain examples, the seat height is 21 inches. In certain examples, upholstery or covering of the seat portion is replaceable in the field without removing the chair. In certain examples, one or more speakers can be positioned in the chair, under the chair, in the chair seat, in the chair back, in the support member, in the floorplate assembly, etc. In certain examples, one or more lights can be positioned in the chair, under the chair, in the chair seat, in the chair back, in the support member, in the floorplate assembly, etc.

While the examples depicted and described herein have been illustrated using a chair with a seat and a back, the floorplate assembly is also applicable to stools and/or other chairs having a seat or base but no back. The cover and mounting plate of the sliding base portion provide support and restriction of movement in some directions, while the opening in the cover enables movement along a specific direction or axis. In conjunction with the floorplate, the sliding base portion enables a chair to be connected and/or otherwise positioned with respect to an external device and allow a certain range of additional movement, swivel, etc., once positioned with respect to the external device.

Further examples and combinations thereof include the following:

Example 1 is a chair apparatus including: a chair portion; and a base portion including a support member and a floorplate assembly including a slide portion and a floorplate, the slide portion including a mounting plate and a cover with an opening, the chair portion affixed to the support member, the support member extending through the opening and affixed to the mounting plate, the mounting plate movable within the opening of the cover to slide the chair portion along a portion of the slide portion.

Example 2 includes the chair apparatus of example 1, wherein the slide portion includes a plurality of rails positioned under the cover to facilitate movement of the mounting plate.

Example 3 includes the chair apparatus of example 2, wherein the slide portion includes a plurality of guides affixed to the mounting plate, ones of the plurality of guides positioned with respect to respective ones of the plurality of rails to facilitate movement of the mounting plate.

Example 4 includes the chair apparatus of example 3, wherein each of the plurality of guides includes a first part affixed to the mounting plate and a second part positioned with respect to the respective one of the plurality of rails.

Example 5 includes the chair apparatus of example 1, further including a connector to connect to an external device.

Example 6 includes the chair apparatus of example 5, wherein the external device includes at least one of a gaming machine, a power source, a server, a meter, or a sensor.

Example 7 includes the chair apparatus of example 1, further including a speaker.

Example 8 includes the chair apparatus of example 1, wherein the chair portion includes a chair back and a chair seat.

Example 9 includes the chair apparatus of example 1, wherein a first width of the cover is less than a second width of the floorplate, and a width of the mounting plate is less than the width of the cover.

Example 10 includes the chair apparatus of example 1, wherein a ratio of a length of the mounting plate to a depth of a seat of the chair portion is approximately 0.58.

Example 11 includes the chair apparatus of example 1, wherein a ratio of a length of the mounting plate a height of a seat of the chair portion is approximately 0.52.

Example 12 includes the chair apparatus of example 1, wherein a ratio of a depth of a seat of the chair portion to a height of the seat of the chair portion is approximately 0.90.

Example 13 is a chair apparatus including: a chair portion means; and a base portion means, the chair portion means affixed to the base portion means and movable in a specified direction with respective to the base portion means.

Example 14 includes the chair apparatus of example 13, wherein the base portion means includes a support member means and a floorplate assembly means, the floorplate assembly including a slide portion means and a floorplate means, the slide portion means including a mounting means and a cover means, the mounting means movable as constrained by the cover means to position the chair portion means.

Example 15 includes the chair apparatus of example 13, further including a connector means.

Although certain example methods, apparatus and articles of manufacture have been described herein, the scope of coverage of this patent is not limited thereto. On the contrary, this patent covers all methods, apparatus and articles of manufacture fairly falling within the scope of the claims of this patent.

The invention claimed is:

1. A chair apparatus comprising:

a chair portion; and a base portion including a support member and a floorplate assembly including a slide portion and a floorplate, the slide portion including a mounting plate and a cover with an opening, the slide portion affixed to the floorplate at a first end, the floorplate including a connector to connect to an external device at a second end, the floorplate including a first portion covered by the cover and a second portion not covered by the cover such that the second portion accommodates a user, the second portion extending between the slide portion at the first end and the connector at the second end, the floorplate further including a conduit on an underside of the floorplate assembly, the conduit connected at a third end to the connector and connected at a fourth end inside the floorplate, the chair portion affixed to the support member, the support member extending through the opening and affixed to the mounting plate, the mounting plate movable within the opening of the cover to slide the chair portion along a portion of the slide portion, the cover having a first width, the floorplate having a second width, and the mounting plate having a third width, wherein the first width of the cover is less than the second width of the floorplate, and the third width of the mounting plate is less than the first width of the cover.

2. The chair apparatus of claim 1, wherein the slide portion includes a plurality of rails positioned under the cover to facilitate movement of the mounting plate.

3. The chair apparatus of claim 2, wherein the slide portion includes a plurality of guides affixed to the mounting plate, and wherein each guide of the plurality of guides is positioned with respect to a corresponding rail of the plurality of rails to facilitate movement of the mounting plate.

4. The chair apparatus of claim 3, wherein each of the plurality of guides includes a first part affixed to the mounting plate and a second part positioned with respect to the respective one of the plurality of rails.

5. The chair apparatus of claim 1, wherein the external device includes at least one of a gaming machine, a power source, a server, a meter, or a sensor.

6. The chair apparatus of claim 1, further including a speaker.

7. The chair apparatus of claim 1, wherein the chair portion includes a chair back and a chair seat.

8. The chair apparatus of claim 1, wherein a ratio of a length of the mounting plate to a depth of a seat of the chair portion is approximately 0.58.

9. The chair apparatus of claim 1, wherein a ratio of a length of the mounting plate a height of a seat of the chair portion is approximately 0.52.

10. The chair apparatus of claim 1, wherein a ratio of a depth of a seat of the chair portion to a height of the seat of the chair portion is approximately 0.90.

11. The chair apparatus of claim 1, wherein the conduit includes wiring.

12. The chair apparatus of claim 1, wherein the floorplate includes a limiter to limit the slide portion from traversing an entire length of the floorplate.

* * * * *